United States Patent [19]

Bishop

[11] 4,032,012

[45] June 28, 1977

[54] SCARF AND HAT KIT

[76] Inventor: Enola Bishop, 5808 N. Winthrop, Chicago, Ill. 60660

[22] Filed: Aug. 24, 1976

[21] Appl. No.: 717,035

[52] U.S. Cl. ..... 206/574; 2/198; 223/109 R; 206/227

[51] Int. Cl.[2] ..... B65D 69/00

[58] Field of Search ..... 2/195, 192, 195, 198, 2/243 R, 243 B; 223/7, 22, 102, 109 R; 206/223, 227, 232

[56] References Cited

UNITED STATES PATENTS

| | | | |
|---|---|---|---|
| 3,035,689 | 5/1962 | Arnheiter | 206/223 |
| 3,136,412 | 6/1964 | Karosen | 206/223 X |
| 3,322,310 | 5/1967 | Higgs | 206/227 X |
| 3,384,220 | 5/1968 | Linstead | 206/223 |
| 3,717,246 | 2/1973 | Cuddeback | 206/227 |

FOREIGN PATENTS OR APPLICATIONS

| | | | |
|---|---|---|---|
| 575,103 | 12/1923 | France | 206/223 |

*Primary Examiner*—Steven E. Lipman
*Attorney, Agent, or Firm*—Allen D. Brufsky

[57] ABSTRACT

A kit for sewing a scarf and a hat from a plurality of individual fabric strips provided in a box having individual compartments for the strips and sewing material, the sewing material includes a plurality of individual yarn lengths permanently attached to a needle which remains in the finished article as decoration.

7 Claims, 5 Drawing Figures

SCARF AND HAT KIT

BACKGROUND OF THE INVENTION

This invention relates to a kit, and more particularly a sewing kit for assembling a hat and a scarf.

Knitted hats and scarves are currently in vogue. Many women find relaxation and enjoyment in fabricating such articles themselves, particularly where such articles can be made with reduced cost. This invention provides a kit for this purpose.

SUMMARY OF THE INVENTION

In accordance with the invention, a package containing a plurality of pre-knitted or crocheted fabric strips is provided. A plurality of different colored lengths of yarn permanently attached to a soft plastic or pliable nylon needle in the package are used to sew the strips together in overlapped relation to form both a scarf and a hat. The needle is left in the sewn fabric strips as a decoration. The sewing yarn can be of different colors so different decorative effects or trim may be provided in the finished products as suits the taste of the user.

BRIEF DESCRIPTION OF THE DRAWING

Further objects and advantages of the invention will become apparent from the following description and claims, and from the accompanying drawing, wherein:

DETAILED DESCRIPTION OF THE PREFERRED EMBODIMENT

Figure 5:
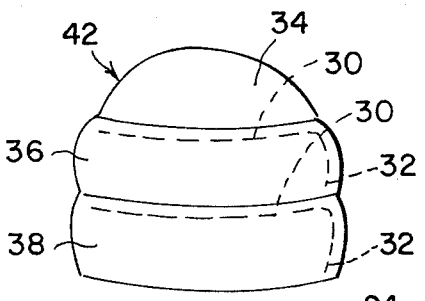
FIG. 5 is a side view in elevation of a hat assembled using the components of FIG. 1.
Figure 1:
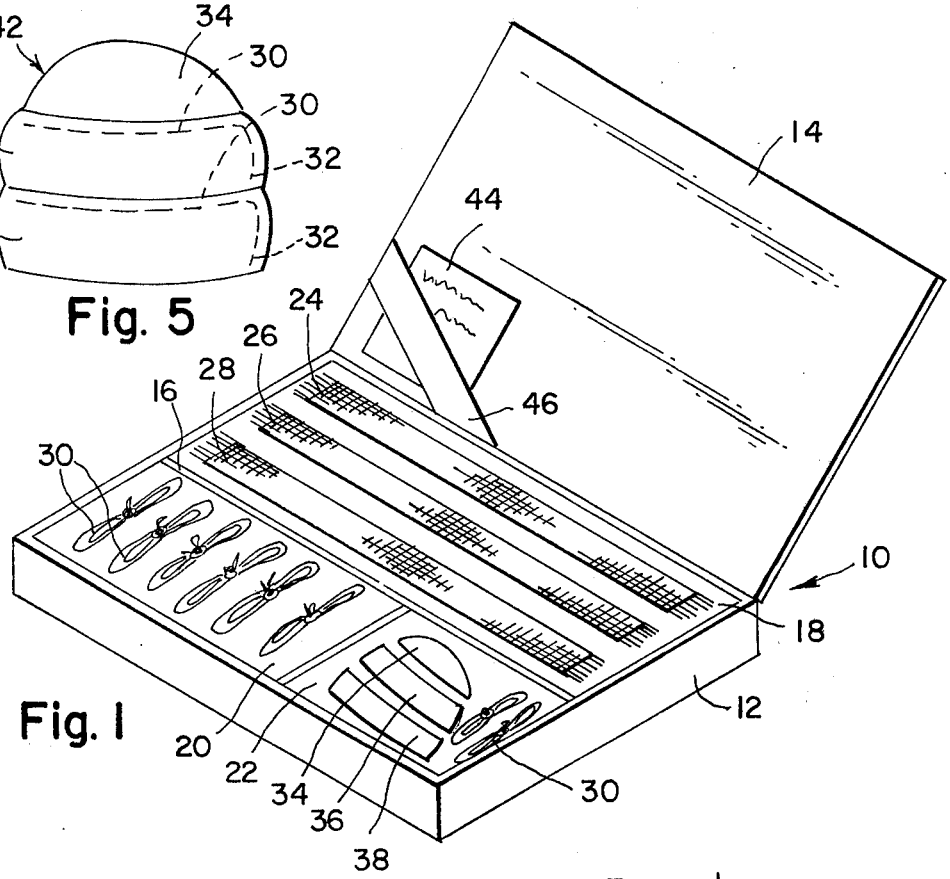
FIG. 1 is a perspective view of the kit of the present invention.
Figure 2:
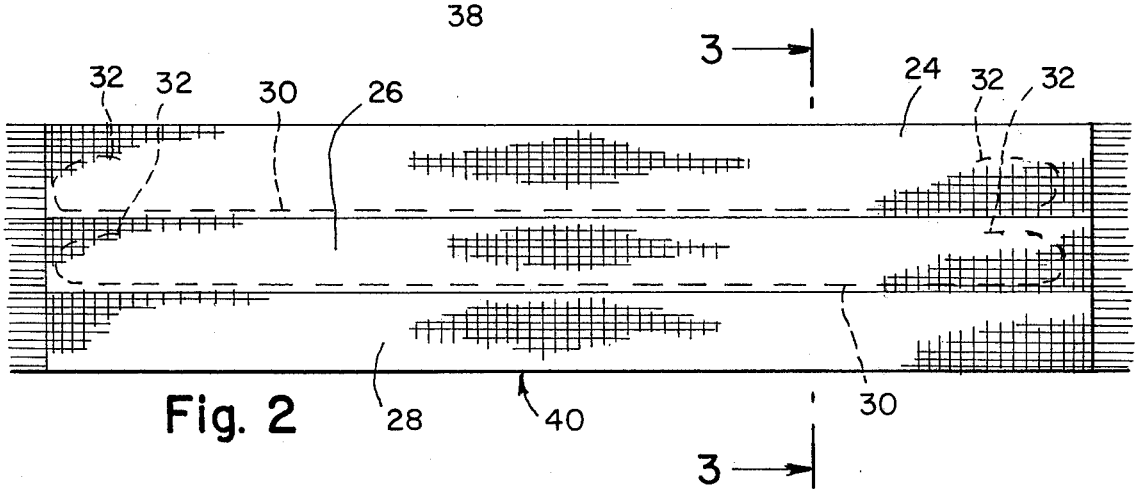
FIG. 2 is a top plan view of a scarf assembled using the components of the kit of FIG. 1.

Referring now in detail to the drawing, wherein like numerals indicate like elements throughout the several views, the kit 10 of the present invention includes a substantially rectangular box 12 having a cover 14 and a number of vertical partitions 16 dividing the box 12 into a plurality of compartments 18, 20, and 22.

Compartment 18 includes three pre-knitted or crocheted fabric strips 24, 26 and 28 of equal length. The strips may be of the same or different colors. Compartment 20 includes six lengths of yarn 30 having a pliable plastic needle 32 attached to both ends. The needles 32 can be crimped onto the yarn ends or adhesively attached. Each yarn length 30 may be of different color. Compartment 22 also includes three pre-knitted or crocheted fabric strips 34, 36 and 38 of unequal lengths, along with a pair of yarn lengths 30 connected to needles 32 at both ends. Strip 34 is substantially semi-circular in shape, kit strips 36 and 38, as strips 24, 26 and 28 are substantially rectangular in shape.

Figure 3:
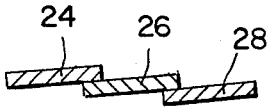
FIG. 3 is a cross-sectional view taken substantially along the plane indicated by line 3—3 of FIG. 2.
Figure 4:
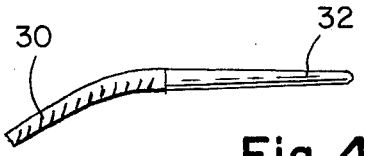
FIG. 4 is a side view in elevation of a length of yarn and a needle used to form the scarf of FIG. 2.

In using kit 10, the edges of strips 24, 26 and 28 are overlapped as indicated in FIG. 3, and the overlapped edges sewn together using two of the yarn lengths 30 by inserting the needles 32 between the fabric weave of the strips 24, 26 and 28. The needles 32 are then turned back towards the center of the stitched yarn 30 and left in the fabric strips 24 and 26 as decoration for the finished scarf 40. Similarly, as shown in FIG. 5, a hat 42 can be sewn in the same manner using strips 34, 36 and 38. The strips 34, 36 and 38 are however, sewn together in a circle, needle 32 and some of the yarn 30 connected to the needle being used to form a seam at the edge of the strips.

Because of the excess yarn lengths 30 provided in kit 10, the trim at the seams provided by the yarn lengths may be varied using different colored yarn. This may even be changed by removing one color yarn and resewing the hat 42 or scarf 40 using another yarn length 30.

An instruction booklet 44 secured beneath a strap 46 may also be provided on the corner of cover 14, if desired.

I claim:

1. A sewing kit for forming an article of clothing comprising:
   - a covered box having
   - a plurality of upright partitions therein dividing said box into a plurality of compartments,
   - a plurality of fabric strips in one of said compartments which when sewn together form an article of clothing, and
   - a plurality of individual yarn lengths having at least one needle permanently attached to an end thereof in another one of said compartments for sewing said fabric strips together to form said article of clothing whereby the needles remain a part of the finished article as decoration therefor.

2. A kit in accordance with claim 1 wherein said fabric strips are of substantially equal lengths so when sewn together they will form a scarf.

3. A kit in accordance with claim 1 wherein said fabric strips are of different lengths so that when sewn together they will form a hat.

4. A kit in accordance with claim 1 wherein said needle is formed from soft, pliable plastic.

5. A kit in accordance with claim 1 wherein said fabric strips are pre-knitted.

6. A kit in accordance with claim 1 wherein said fabric strips are crocheted.

7. A kit in accordance with claim 1 including a strap on said cover for receiving and holding an instruction booklet.

* * * * *